US005275535A

United States Patent [19]

Gongwer

[11] Patent Number: 5,275,535

[45] Date of Patent: Jan. 4, 1994

[54] ORTHO SKEW PROPELLER BLADE

[75] Inventor: Calvin A. Gongwer, Glendora, Calif.

[73] Assignee: Innerspace Corporation, Covina, Calif.

[21] Appl. No.: 708,397

[22] Filed: May 31, 1991

[51] Int. Cl.[5] ..... B63H 1/26

[52] U.S. Cl. ..... 416/228; 29/889.6; 29/889.7; 29/889.71; 416/230; 416/219 R; 416/229 R

[58] Field of Search ..... 416/223; 416/229; 416/228; 416/219R; 416/234; 416/230; 29/889.6, 889.7, 29/889.71

[56] References Cited

U.S. PATENT DOCUMENTS

| | | | |
|---|---|---|---|
| 246,506 | 8/1881 | Hirsch | 416/228 |
| 573,562 | 12/1896 | Wittram | 416/228 R |
| 725,639 | 4/1903 | Webber | 416/228 |
| 1,891,612 | 12/1932 | Schmidt | 29/889.6 |
| 2,013,473 | 9/1935 | Meyer et al. | 416/228 |
| 2,738,950 | 3/1956 | Price | 416/223 A |
| 3,057,767 | 10/1962 | Kaplan | 416/230 X |
| 3,368,795 | 2/1968 | Bolin et al. | 416/229 A |
| 4,089,618 | 5/1978 | Patel | 416/228 |
| 4,164,061 | 8/1979 | Bronovsky et al. | 29/889.7 |
| 4,494,910 | 1/1985 | Hahn et al. | 416/230 X |
| 4,621,980 | 11/1986 | Reavely et al. | 416/230 |
| 4,627,791 | 12/1986 | Marshall | 416/230 |
| 4,797,066 | 1/1989 | Stromberg | 416/223 A |
| 5,067,876 | 11/1991 | Moreman, III | 416/219 R |

FOREIGN PATENT DOCUMENTS

| | | | |
|---|---|---|---|
| 639514 | 4/1962 | Canada | 29/889.7 |
| 489881 | 6/1955 | Italy | 29/889.7 |
| 789883 | 1/1958 | United Kingdom | 416/228 |

*Primary Examiner*—Edward K. Look
*Assistant Examiner*—Todd Mattingly
*Attorney, Agent, or Firm*—Lyon & Lyon

[57] ABSTRACT

A blade and method for fabrication of a blade for use on a hub for rotation in a fluid that enjoys the benefits of a skewed blade without the disadvantages. This is accomplished through the use of alternating clockwise skewed and counterclockwise skewed sections formed along the leading edge. In bidirectional applications the alternating clockwise and counterclockwise skewed sections are formed along both edges.

11 Claims, 3 Drawing Sheets

FIG. 1.
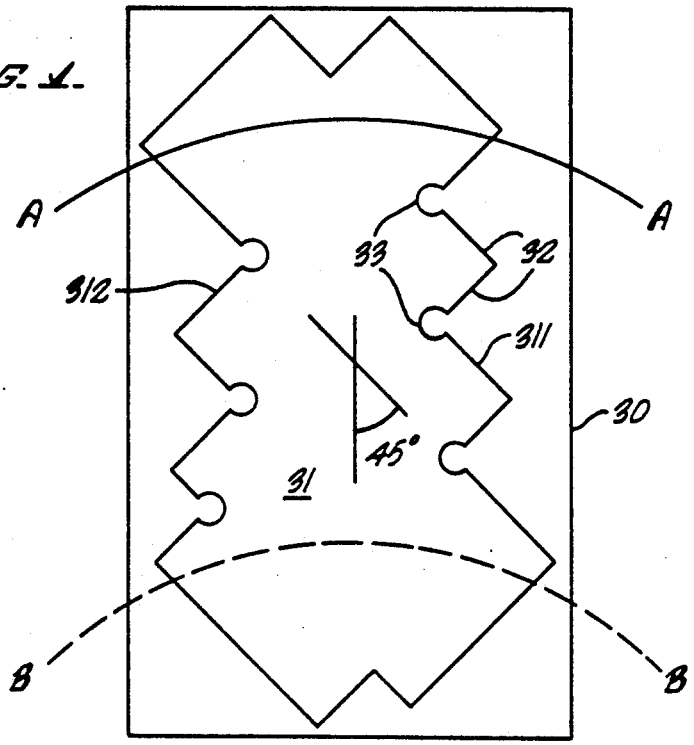
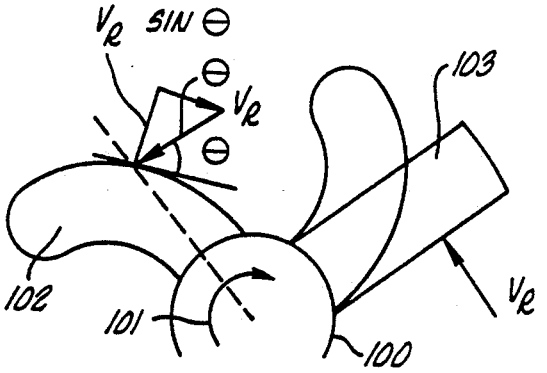
FIG. 2.
(PRIOR ART)
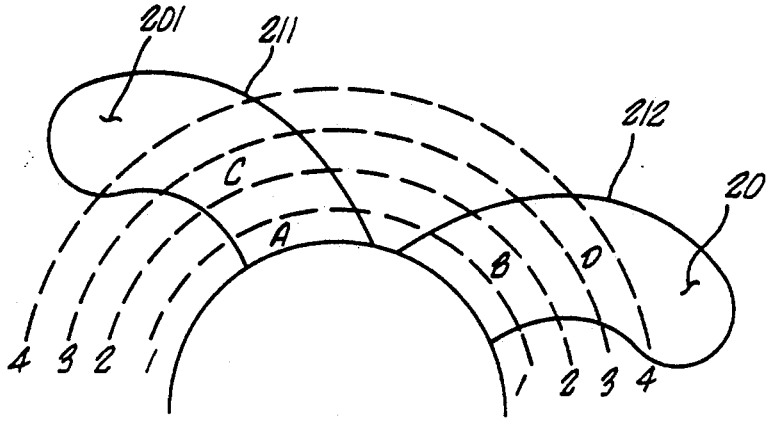
FIG. 3.
(PRIOR ART)

ORTHO SKEW PROPELLER BLADE

BACKGROUND

1. Field of the Invention

The invention pertains generally to the field of blades for fans and propellers. A preferred and advantageous application of the invention pertains to the use of the invention in bidirectional marine thrusters.

2. Prior Art

Traditional blades for propellers or fans have either been oriented on the hub with the longitudinal axis of the blade extending in a substantially straight radial direction from the hub, or more recently, radially skewed such that the leading edge of the blade presents a curved front to the fluid. The skewed blade provides many advantages over the straight blade. These advantages include less noise and less cavitation due to decreased velocity components normal to the leading and trailing edges as the blade travels through the fluid. This advantage can be understood by reference to the velocity vector diagram shown in FIG. 2. As the hub 100 rotates in a clockwise direction as indicated by direction of rotation arrow 101, the relative velocity of the fluid impinging the leading edge of straight blade 103 is $V_R$. With a constant rotational velocity, the relative velocity of the fluid $V_R$ will increase as the distance from the center of the hub increases. With a blade skewed for clockwise rotation 102 the curve of the leading edge of the blade can be skewed such that the normal velocity of the fluid impinging the blade edge $V_R$ sin (theta) is constant or is lower by the factor sin (theta). In other words the relative velocity $V_R$ impinges the blade 102 at an angle (theta) so that its component perpendicular to the leading edge is $V_R$ sin (theta). This makes the blade react as if it was in a flow velocity $V_R$sin (theta) rather than $V_R$ with a straight blade 103.

This skewing greatly reduces the underpressures on the blade causing resistance to cavitation and noise. Unfortunately, with the traditional skewed blade, these advantages are achieved only as the result of a loss of stiffness and strength. The skewed propeller is limber, flexible and more easily deformed by lift loads. As is apparent these disadvantages are amplified when the skewed blade 102 is rotated in the opposite direction. Thus, the advantages of the skewed blades have heretofore been constrained to unidirectional applications. The present invention yields all of the advantages of the skewed blades without the disadvantages.

SUMMARY OF THE INVENTION

The present invention comprises a blade with a substantially straight longitudinal axis with at least one edge having alternatively sections skewed for clockwise rotation and sections skewed for counterclockwise rotation along the length of the blade edge forming a notched pattern. In one application both edges comprise alternating clockwise and counterclockwise skewed sections for use in a bi-directional system. In either embodiment, the blades may be wrapped with a fiber to add strength and formed with a curved cross-section to further decrease drag.

Accordingly, it is an object of this invention to provide a blade that enjoys the benefits of a prior art skewed blade without the disadvantages.

BRIEF DESCRIPTION OF THE DRAWINGS

FIG. 1 is a plan view of blank with a blade mandrel of the present invention developed thereon.

FIG. 2 is shows the relative velocity vector diagram for a prior art skewed blade and a prior art straight blade.

FIG. 3 is a diagram of a prior art clockwise skewed blade and a prior art counterclockwise skewed blade.

FIG. 8' is an end view taken along plane 8—8 of FIG. 4 wherein the blade has a modest camber.

DETAILED DESCRIPTION OF THE PRESENTLY PREFERRED EMBODIMENT

Figure 4:
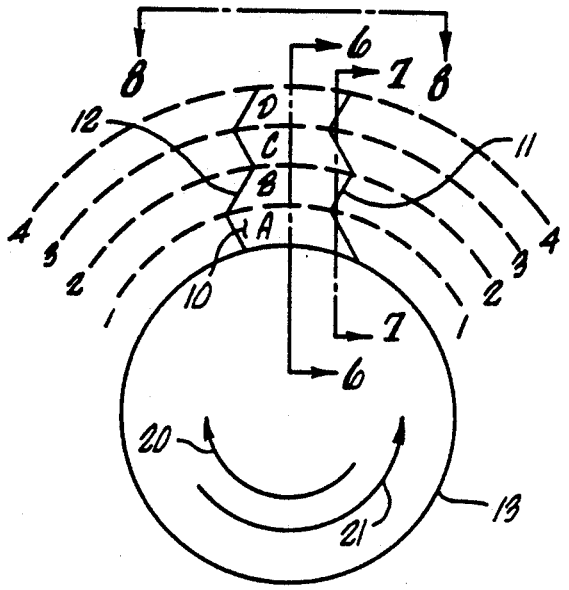
FIG. 4 is a front view of a blade of the present invention mounted on a hub for a bidirectional application.

As best shown in FIG. 4, the presently preferred application of this invention is for use in a bi-directional marine thruster such as the Innerspace Corp. Model 1002 marine thruster. In this application both edges of the blade 10 have alternating clockwise and counterclockwise skewed sections. The source of the curves forming the first edge 11 and the second edge 12, can best be understood by reference to FIG. 3.

FIG. 3 depicts a blade 201 skewed for rotation in a clockwise direction and blade 202 skewed for rotation in a counterclockwise direction. For the purposes of this description, arbitrary constant radius lines 1—1, 2—2, 3—3 and 4—4 have been indicated dividing each of the blades 201 and 202 into sections. The first section A of blade 10 shown in FIG. 4 is identical in configuration to the first section A of clockwise skewed blade 201 of FIG. 3. The second section B of blade 10 is identical in configuration to the second section B of counterclockwise skewed blade 202. The third section C of blade 10 is identical in configuration to the third section C of clockwise skewed blade 201. The fourth section D of blade 10 is identical in configuration to the fourth section D of counterclockise skewed blade 202.

Thus, it will be seen that when the hub 13 is rotated in either the clockwise direction as indicated by direction arrow 20 or the counterclockwise direction as indicated by the direction arrow 21 the leading edge of the blade 10 impinging against the fluid will be skewed. As shown in FIG. 2, when the blade 10 is rotated in either the clockwise direction 20 or the counterclockwise direction 21 the actual normal velocity vector realized for sections A, B, C and D will be $V_R$ sin(theta) yielding the benefits of the skewed blades 201 and 202. Unlike the blades 201 and 202, however blade 10 is symmetrical about the radial line and the moments created on the edges 11 and 12 with respect to the radial line are relatively low compared with the moments along the edges 211 and 212 of blades 201 and 202 respectively. Thus, the benefits of skewed blades are realized without the disadvantage of loss of stiffness and strength.

As will be evident to anyone skilled in the art it would be a simple matter to further increase the stiffness of the blade 10 if the application were for a unidirectional application. For example, if the application was for unidirectional rotation in the clockwise direction 20, the leading edge 11 would be formed with alternating clockwise and counterclockwise skewed sections and the trailing edge 12 would be straight. (preferred notched on both edges)

As is typical in the manufacture of blades for propellers and fans the blade can be wrapped with carbon or other fibers and then immersed in an epoxy or other resin to form a high strength very rigid shell around the blade.

A preferred method of forming a blade incorporating the present invention is by starting with a flat rectangular blank 30 as shown in FIG. 1. The blank can be of any metal, e.g., aluminum or other material, e.g., high strength plastic. the clockwise and counterclockwise skewed sections for each edge 311 and 312 are then laid out on the blank. If the blade mandrel 31 is to be used in a unidirectional application the edge 311 may be laid out with clockwise and counterclockwise skewed sections and the edge 312 may be straight. In the presently preferred embodiment the skew angle has been chosen to be 45° and the angled edges 32 straight. Of course, depending upon the application, different angles and shapes may prove to be more advantageous.

Figure 5:
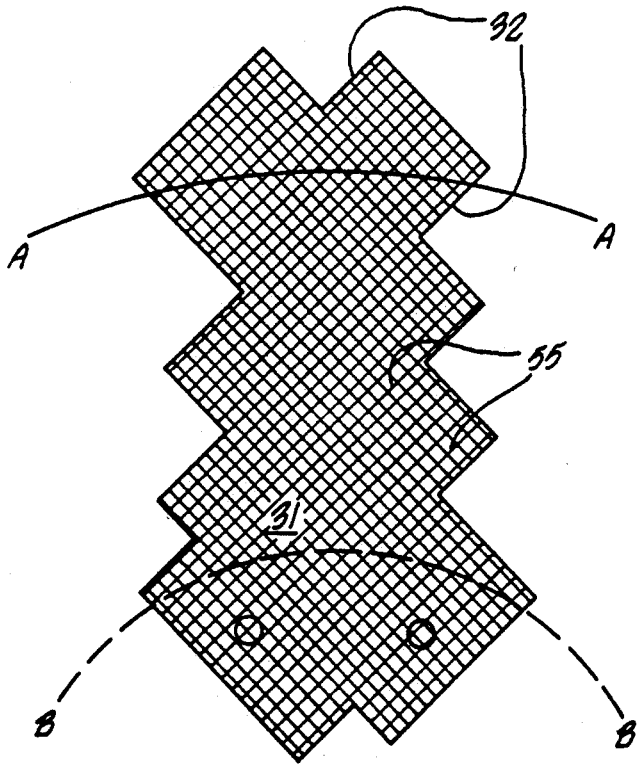
FIG. 5 is a drawing of the blade mandrel of FIG. 1 with carbon fiber wrapping.
Figure 5:
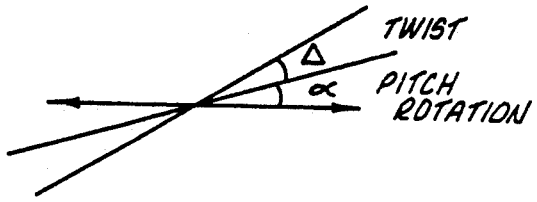

If the blade mandrel 31 is to be fiber wrapped it has been found advantageous to continue the angled edges beyond the trim line A—A and the hub line B—B. After the blade blank 31 is cut from the rectangular blank 30 it is twisted to make the desired pitch distribution from the root to the tip. It has been found that a typical desirable twist is 16°. To ensure that the pitch is uniform the twisting is preferably performed prior to notching and edge shaping. The edges of the blade mandrel may be thinned or tapered. Additionally, to prevent a build-up of fiber at the corners and to provide an anchorage for the fibers, relief notches 33 may be employed. The carbon fibers, as shown by the cross-hatching 55 in FIG. 5, are Wrapped around the blade mandrel 31 before trimming. By wrapping prior to trimming, full advantage of the continuation of the angled edges 32 may be realized. The wrapping of the fibers at an angle less than 90° from radial, such as 45° stiffens the blade in both torsion and bending. As is evident from FIG. 5, the angled edges 32 extending beyond the trim line A—A facilitate the fiber wrapping by providing parallel edges to maintain the fibers in proper diagonal alignment.

It has been found preferable to stagger the angled edges 32 on each of the edges 11 and 12 as shown in FIG. 4. This staggering results in a blade 10 with an essentially constant circumferential breadth (chord) from the root to the tip. Thus, the width of the cross-section along lines 1—1, 2—2, 3—3 and 4—4 is essentially constant.

Figure 6:
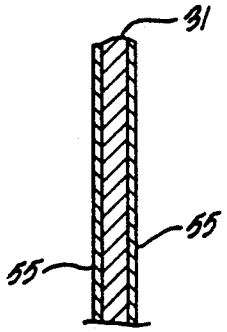
FIG. 6 is a cross-sectional view taken along plane 6—6 of FIG. 4.
Figure 7:
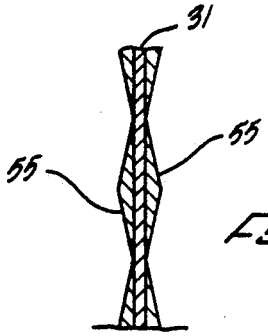
FIG. 7 is a cross-sectional view taken along plane 7—7 of FIG. 4.

The diagonal wrap also results in a forming of the blade 10 with a naturally contoured surface. The cross-sectional thickness along the radial centerline of the blade 10 is essentially constant as shown in FIG. 6. The cross-sectional thickness along a radial line close to the edge 11 will vary as shown in FIG. 7.

Figure 8:
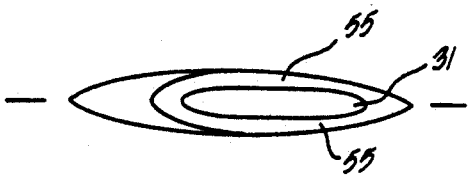
FIG. 8 is an end view taken along plane 8—8 of FIG. 4.
Figure 8:
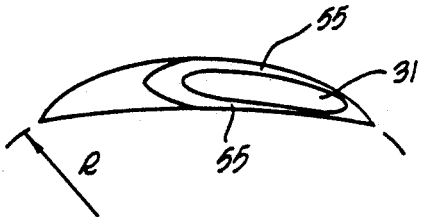
Figure 9:
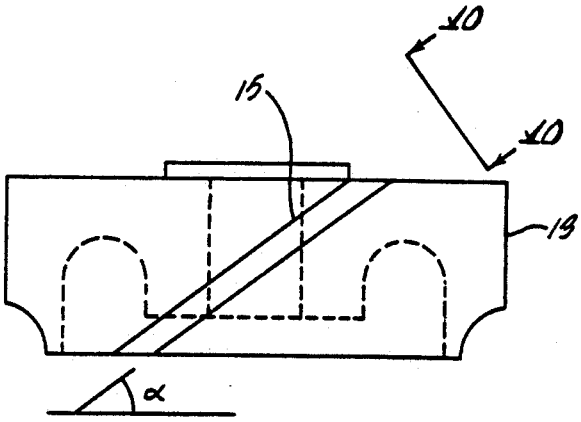
FIG. 9 is a radial view of the hub of FIG. 4.
Figure 10:
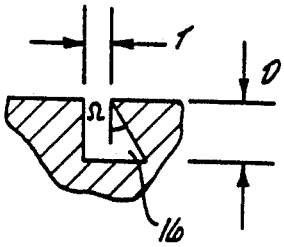
FIG. 10 is a partial view taken along plane 10—10 of FIG. 9.

As shown in FIG. 8 and FIG. 8' the blade 10 may be formed with or without a camber as the particular application warrants.

The blade 10 may then be mounted to the hub 13 by the formation of a slot 15 cut at the desired pitch angle (alpha). It has been found that typically a slot 15 with a maximum depth D of 0.375" at the center and a uniform width T of 0.25" along the length of the slot is the most preferable. Additional, an undercut 16 on one of the sides of the slot 15 is desirable. Preferably the undercut angle (omega) is about 15°.

The blade 10 and hub 13 may of course be cast in a single piece without sacrificing any of the benefits of the invention. The cast would have to incorporate the notching and angled sides as described above.

While embodiments and applications of this invention have been shown and described, it will be apparent to those skilled in the art that many more modifications are possible without departing from the inventive concepts described herein. The invention therefore is not to be restricted except in the spirit of the appended claims.

I claim as follows:

1. A method of fabricating a blade for use on a hub for rotation in a fluid comprising the steps of a. developing the pattern of the blade on a blank wherein the pattern includes alternating clockwise skewed and counterclockwise skewed section along at least one edge of the developed blade;

b. cutting the blade mandrel from the blank along the developed lines;

c. twisting the blade mandrel to the desired pitch;

d. forming notches at the intersection of the alternating clockwise and counterclockwise skewed sections;

e. wrapping a first layer of fiber around the blade mandrel;

f. dipping the wrapped blade mandrel in resinous material; an g. attaching the fiber wrapped blade to a hub.

2. The method of claim 1 wherein the step of wrapping the fiber around the blade mandrel further comprises wrapping the fiber at an angle to the longitudinal axis of the blade mandrel.

3. The method of claim 1 wherein the step of forming notches further comprises the step of trimming said blade to plan form.

4. The method of claim 1 further comprising the step of tapering the edges of the mandrel.

5. The method of either claim 1 or 4 further comprising the step of wrapping an additional layer of fibers in the direction perpendicular to the direction in the first layer.

6. The method of claim 1 further comprising the step of curing the resinous material to full strength.

7. The method of claim 1 further comprising the step of finishing the blade to shape.

8. A marine thruster comprising a plurality of blades affixed to a hub wherein the blades comprise a contoured cross-section, a substantially constant cross-sectional thickness along the radial centerline of said blades, a first edge and a second edge; wherein said first edge is the leading edge of said blade, and including alternating clockwise skewed sections and counterclockwise skewed sections formed along said first edge of said blades wherein said skewed sections are skewed with respect to the radial axis of said blade and the direction of rotation of said blade and wherein a notch is formed at the intersection of said alternating clockwise and counterclockwise skewed section in a blade mandrel of said blades.

9. The marine thruster of claim 8 wherein said marine thruster is bi-directional and both said first and second edges of said blades are formed with alternating clockwise skewed and counterclockwise skewed sections.

10. The marine thruster as claimed in any of claims 8 or 9 wherein said blades are encased in a fiber wrap.

11. The marine thruster of claim 10 wherein the fibers in said fiber wrap are oriented at an angle to the longitudinal axis of said blades.

* * * * *